United States Patent [19]
McDowell
[11] 4,210,243
[45] Jul. 1, 1980

[54] TRAY FOR HOLDING COMPONENTS WITH PREFORMED LEADS

[75] Inventor: Jeffrey B. McDowell, Rio Rancho, N. Mex.

[73] Assignee: GTE Automatic Electric Laboratories, Inc., Northlake, Ill.

[21] Appl. No.: 972,751

[22] Filed: Dec. 26, 1978

[51] Int. Cl.² ..... B65D 73/02
[52] U.S. Cl. ..... 206/332; 206/526; 206/539; 206/564; 53/473
[58] Field of Search ..... 206/328-329, 206/331-332, 334, 392, 534.1, 539, 526, 557, 561, 564; 229/2.5; 220/20; 339/17 F; D7/37-38, 96; D9/183, 187, 189, 219; 53/437, 473, 525, 539

[56] References Cited

U.S. PATENT DOCUMENTS

| | | | |
|---|---|---|---|
| 2,188,492 | 1/1940 | Young | D9/187 X |
| 2,429,063 | 10/1947 | Jones et al. | 206/539 X |
| 2,821,307 | 1/1958 | Linsley | 206/332 X |
| 2,833,091 | 5/1958 | Whitney | 53/525 X |
| 3,184,056 | 5/1965 | Kisor | 206/331 |
| 3,469,686 | 9/1969 | Gutsche et al. | 206/332 |
| 3,624,776 | 11/1971 | Gordon | 206/392 |
| 3,700,100 | 10/1972 | Bohannon, Jr. | 206/332 |
| 3,848,395 | 11/1974 | Totten | 53/473 |

*Primary Examiner*—Herbert F. Ross
*Attorney, Agent, or Firm*—Russell A. Cannon

[57] ABSTRACT

A tray for holding IC packages including cylindrical cases having preformed leads flared radially outward from the bottom thereof with flat portions of the free ends of leads being in a common plane. The tray comprises a top plate having a plurality of funnel shaped openings in it, a rim around the perimeter of the plate, and a flat bottom. Each opening has a cylindrical bottom portion for receiving a case with leads thereon being located in the flared upper portion of the opening and below the surface of the plate. The top and bottom edges of trays are dimensioned so that the top of a first tray nests inside the bottom of a second tray. By merely turning these nested trays over, packages in openings in the first tray sit with the flat portions of leads on the bottom of the second tray. The rim limits transverse movement of packages set on the plate when the tray is shaken to cause them to fall into associated openings.

3 Claims, 3 Drawing Figures

TRAY FOR HOLDING COMPONENTS WITH PREFORMED LEADS

BACKGROUND OF INVENTION

This invention relates to apparatus for holding components and more particularly to a tray for holding components packaged in cylindrical cases that have a plurality of preformed leads flared radially outward from the bottom thereof.

Transistors and integrated circuits (IC) for use in thick film hybrid circuits are often packaged in cylindrical metal can type cases that are of prescribed dimensions and have a plurality of parallel leads of prescribed length extending through a dielectric header in the bottom end thereof. A transistor has 3 or 4 leads whereas an IC typically has 8 or 10 leads. In the manufacturing of thick film hybrids, each lead of a package is placed in contact with solder paste on an associated conductive land on a substrate which is then reflow soldered to complete its electrical connection into the circuit. In order to facilitate manufacture of hybrid circuits, leads of packages are preformed into a prescribed pattern, normally being tapered radially outward from the bottom of the case with flat portions on the free ends of the leads being in a common plane. It is then relatively easy to locate the flat portions of leads in paste solder on a substrate. Bulk storage of components with preformed leads has previously been in bins. Since the leads on IC packages are thin and pliable, however, they become tangled and bent in bulk storage such that the flat portions thereof are no longer in a common plane. This causes extensive hand rework in reforming the leads prior to locating them on substrates and may result in faulty solder connections in a hybrid circuit. Flat styrofoam plates having large holes in the top thereof have also been used for storing and transporting IC packages with preformed leads. It is necessary to individually place IC packages in and remove them from holes in such plates since extra care must be exercised so as to not catch a component lead in a soft surface of the styrofoam plate and bend it.

An object of this invention is the provision of a tray for holding electrical components packaged in cylindrical cases having preformed leads projecting from the bottom thereof. Another object is the provision of trays for storing and transporting such packaged components.

SUMMARY OF INVENTION

In accordance with this invention, a tray for holding electrical component packages, each package including a cylindrical case having a plurality of preformed leads extending from the bottom thereof with flat portions on the free ends of leads being in a common plane, comprises a top plate having a plurality of funnel shaped openings formed in the top surface thereof, the lower portion of each opening being a cylindrical shaped hole for receiving a cylindrical case and the top portion of each opening being tapered outward toward the plate for receiving leads. The trays preferrably have flat bottoms and are dimensioned so that the top edges of one tray nest inside the bottom edges of another tray. Thus, when a pair of nested trays are turned over, component packages in openings in one tray sit on the flat portions of leads on the bottom surface of another tray. A rim around the plate limits movements of component packages loaded in bulk on it when the tray is shaken to cause them to drop into associated openings.

DESCRIPTION OF DRAWINGS

This invention will be more fully understood from the following detailed description, together with the drawings in which.

DESCRIPTION OF PREFERRED EMBODIMENTS

Figure 1:
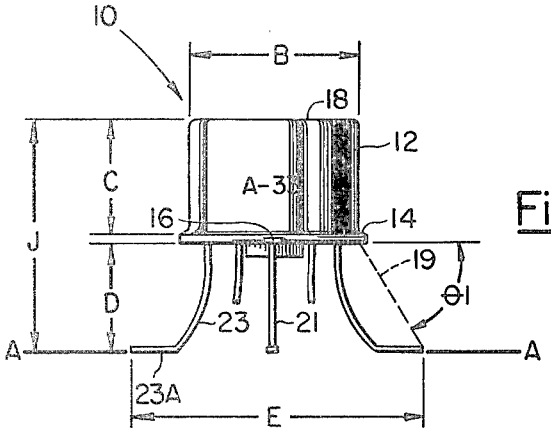
FIG. 1 is a front elevation view of an integrated circuit package 10 that includes a cylindrical case 12 having a plurality of preformed leads 21–28 extending from the bottom thereof.

The integrated circuit package 10 in FIG. 1 is conventional and may be an 8-lead TO-99 IC package comprising a cylindrical metal can type case 12 having a nominal diameter B=0.350 inch, a height C=0.320 inch, and gold plated leads 21–28 that are formed in the prescribed pattern for use in a hybrid circuit. The leads are tapered radially outward so as to have flat portions such as 23A which are in a common plane A—A and may be spaced a distance D=0.080 inch below the flange 14 on the case. The free ends of the leads here are in a circle having a diameter E of approximately 0.60 inch. This causes a line 19 through the end of a lead and the intersection of the side and flange on the case to intersect the plane of the flange 14 at an angle $\theta 1$ of approximately 60°.

Figure 3:
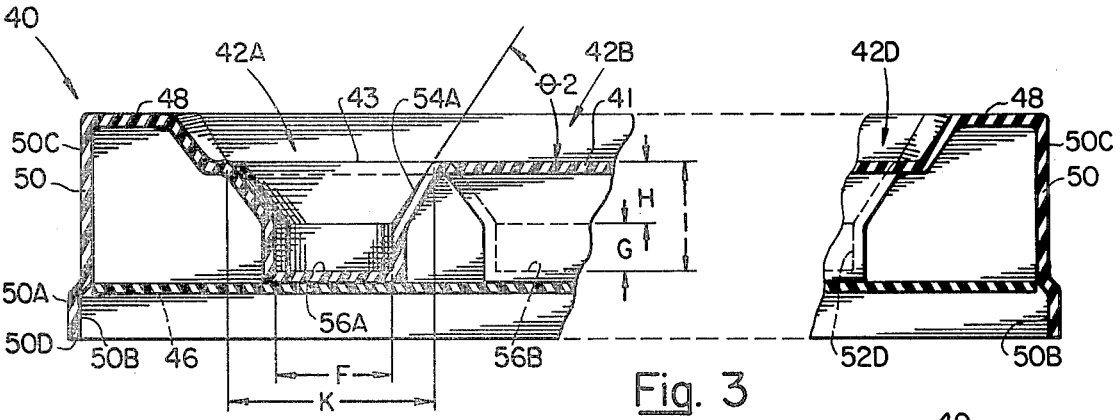
FIG. 3 is a section view of the tray 40 taken along line 3—3 in FIG. 2.
Figure 2:
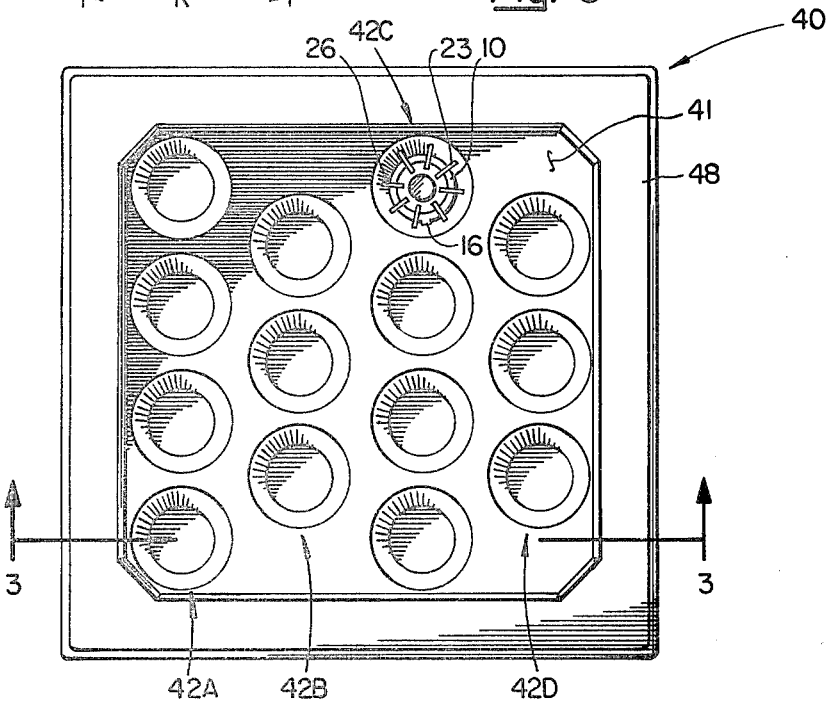
FIG. 2 is a plan view of a tray 40 embodying this invention.

Referring now to FIGS. 2 and 3, a rectangular tray 40 embodying this invention comprises a flat top member 41 having a plurality of funnel shaped openings 42 formed therein, a flat bottom 46, a rim 48 extending above the top member 41 and around the perimeter of the tray, and sides 50 that are flared outward at the bottoms 50A thereof which extend below the bottom 46. The funnel shaped opening 42A, for example, has a lower portion that is a cylindrical hole 52A and an upper portion 54A that is defined by the surface of a truncated cone. This causes the upper portions of holes 42 to be tapered outward in the direction of the top surface 43 of member 41. The diameter F of the hole 52A is slightly greater than the diameter B in FIG. 1 to provide a slip fit of a case 12 into a hole 52. The depth G of the hole 52A is preferrably somewhat less than the height C in FIG. 1 so that the tab 16 and flange 14 on a case 12 that is located in hole 42A are spaced from the conically shaped surfaces 54A. The thickness H of the truncated section 54A is preferrably greater than the lead spacing D in FIG. 1 so that the flat sections of leads on a case 12 located in a hole 52 will be below the top surface 43. The spacing I between the bottom 56 of holes 52 and the top surface 43 is also preferrably less than the spacing J between the top 18 of the case 12 and the plane A—A in FIG. 1 for a similar reason. The lines formed by the truncated conical surfaces 54 in FIG. 3 make an angle $\theta 2$ with the top surface 43 which is slightly less than the angle $\theta 1$ in FIG. 1 so that the free ends of ones of the leads 21–28 may be spaced from the surface 54C when a case 12 is located in the opening 52C as is illustrated in FIG. 2. It is readily seen, therefore, that when a package 10 is located in an inverted position in a funnel shaped opening 42 with the case 12 in a hole 52 and the top 18 of the case contacting the bottom 56 of the hole, then the flat portions of the leads 21–28 are spaced below the top surface 43 to protect them from being bent.

The rim 48 rises approximately ⅛ inch above the top surface 43 and extends around the full perimeter of the member 41. This rim 48 prevents IC packages 10, that are placed en masse and randomly on the member 41, from falling off of the tray as it is vibrated in the plane of the paper in FIG. 2 to cause packages to fall into and seat themselves in associated ones of the openings 42.

Opposite sides 50 of the tray are generally parallel to each other and perpendicular to the plane of the paper in FIG. 2. The lower portions 50A of the sides are also flared outward at the bottom of the tray so that the spacing between inner surfaces 50B of opposite sides is somewhat greater than the spacing between outer surfaces 50C of the same opposite sides of the tray. This spacing is selected to provide a slip fit of the upper portion of the sides and rim 48 on one tray 40 into the flared opening in the bottom of a second tray. In this way, the rim 48 and top portion of one tray nest in the bottom portion of another tray such that they can be stacked for convenient and safe storage.

The flat bottom plate 46 is glued, for example, to the undersides of the bottoms 56 of holes 52. The bottom edges 50D extend approximately ¼ inch below plate 46 which facilitates unloading packages 10 from a tray 40. This is accomplished by nesting a first tray having packages 10 in openings 42 thereof in the bottom of a second tray that is empty. When this pair of nested trays is turned over (rotated 180°), the packages in the first tray stand upright (see FIG. 1) on the flat bottom 46 of the second tray. The packages 10 may then be visually inspected to see that they all bear the same designation number on the side of the case (see FIG. 1) and that the flat portions of leads are in a common plane. The packages may be individually removed from the bottom of a tray and assembled directly onto hybrid substrates (not shown).

The tray 40 is preferrably formed of a plastic material such as acrylic polyvinyl chloride having exterior surfaces which are smooth and relatively hard. Such a plastic tray 40 may be readily formed by vacuum molding. A flat bottom 46 may then be cut to the desired size and glued into the bottom of the vacuum formed tray. Alternatively, the tray may be molded out of a polystyrene material, for example, surfaces thereof which are to come into contact with the IC package being treated to form a smooth, hard surface which cannot be penetrated by the sharp ends of the leads. It is only necessary that the surfaces of the tray which come in contact with the IC package be sufficiently smooth and of a hardness which resists chipping and enables the pointed ends of the leads to slide smoothly over them. In a tray that was vacuum molded from acrylic polyvinyl chloride and successfully used to store TO-99 packages, F=0.355 inch, G=0.130 inch, H=0.210 inch and K=0.610 inch.

Although this invention is described in relation to preferred embodiments thereof, variations and modifications thereof will occur to those skilled in the art without departing from the spirit of this invention. By way of example, the upper portions 54 of the funnel shaped openings 42 may be convex or concave shaped, or other shapes that provide a gradual entry into the cylindrical holes 52 and protection for component leads. Also, trays may be other than rectangular as long as the shapes of the top edges and the insides of the bottoms thereof are similar, where nesting of trays is desired. Further, the sides 50 of the trays may be tapered over the lengths thereof and openings 42 located in the tops of trays in an order and number different from that illustrated in FIG. 2. Also, the rim 48 may be spaced from the sides 50 of trays. Additionally, components may be other than integrated circuits and may have leads formed in patterns other than that illustrated in FIGS. 1 and 2. The scope of this invention is therefore defined by the appended claims, rather than the aforementioned detailed description of preferred embodiments thereof.

What is claimed is:

1. A storage tray in combination with electrical component packages, each package including a cylindrical can type case having a plurality of preformed leads flared radially outward from the bottom of the case with flat portions on free ends of the leads being in a common plane, said storage tray comprising: a relatively flat top member having a plurality of funnel shaped openings formed in the top surface thereof, the lower portion of each opening being a cylindrically shaped hole with a flat bottom support surface and a diameter somewhat greater than the diameter of the cylindrical can portion of a package located therein, the spacing between the top of a case and the common plane being less than the spacing between the bottom and top surfaces for positioning the flat portions of leads below the top surface, the top portion of each opening being smoothly tapered outward in the direction of the top surface and receiving the preformed leads, surfaces of said top member and openings being relatively smooth and hard for preventing the free ends of leads catching on them, at least some of said openings having said component packages located therein with the tops of said cases resting on the bottom surfaces.

2. A tray according to claim 1 further comprising a rim extending around the perimeter of and above the top member for limiting movement of component packages placed on the top surface when the tray is vibrated to locate packages in an inverted position in associated openings with cases in holes; sides extending below the bottoms of cylindrical holes; and a flat bottom plate that is located below the bottoms of the holes and within the sides, the exterior surfaces of the rim and the interior side surfaces adjacent and below the bottom plate being similarly shaped so that the rim of a first tray nests inside the bottom section of a second tray, inverting nested first and second trays causing packages in openings in the first tray to sit upright with the flat portions of leads on the bottom plate of the second tray.

3. The method of storing leaded component packages in spaced apart locatons, each package including a flat top cylindrical can type case having a plurality of preformed legs flared radially outward from the bottom of the can with flat portions on the free ends of leads being in a common plane, comprising the steps of:

depositing a plurality of said component packages on the flat top surface of a tray having spaced apart funnel shaped openings formed in the flat top surface of the tray with the lower portion of each opening being a cylindrically shaped hole having a bottom and snugly receiving and supporting therein a case, the upper portion of each opening being smoothly tapered outward in the direction of the top surface and receiving flared legs therein with the ends thereof below the top surface; and vibrating the tray and component packages thereon for causing packages to be located in associated openings with cases supported on the bottom surfaces in the lower portions of openings and leads in upper portions of openings with flat ends of leads in a common plane below the top surface for storage in the tray.

* * * * *